US011287206B2

(12) United States Patent
Petera et al.

(10) Patent No.: US 11,287,206 B2
(45) Date of Patent: Mar. 29, 2022

(54) AUTOMATIC ACTION ASSEMBLY OF A FIREARM

(71) Applicant: CESKA ZBROJOVKA A.S., Uhersky Brod (CZ)

(72) Inventors: Lukas Petera, Nove Mesto nad Metuji (CZ); Rene Marek, Prague (CZ); Vladimir Simek, Uhersky Brod (CZ)

(73) Assignee: CESKA ZBROJOVKA A.S., Uhersky Brod (CZ)

( * ) Notice: Subject to any disclaimer, the term of this patent is extended or adjusted under 35 U.S.C. 154(b) by 0 days.

(21) Appl. No.: 17/093,328

(22) Filed: Nov. 9, 2020

(65) Prior Publication Data

US 2021/0140734 A1 May 13, 2021

(30) Foreign Application Priority Data

Nov. 12, 2019 (CZ) ..... PV2019-696

(51) Int. Cl.
*F41A 21/12* (2006.01)
*F41A 3/38* (2006.01)

(52) U.S. Cl.
CPC ..... *F41A 21/12* (2013.01); *F41A 3/38* (2013.01)

(58) Field of Classification Search
CPC ..... F41A 3/38; F41A 3/44; F41A 3/40; F41A 3/46; F41A 21/12; F41A 21/14
USPC ..... 89/155, 183; 42/25
See application file for complete search history.

(56) References Cited

U.S. PATENT DOCUMENTS 2,052,287 A * 8/1936 End ..... F41A 9/65 89/183
2,847,787 A * 8/1958 Williams ..... F41A 3/32 42/76.01
4,069,607 A * 1/1978 Jurek ..... F41A 15/14 42/25
4,172,410 A * 10/1979 Reynolds ..... F41A 3/26 89/11
7,398,614 B2 * 7/2008 Rozhkov ..... F41A 3/56 42/2

* cited by examiner

*Primary Examiner* — John Cooper
(74) *Attorney, Agent, or Firm* — Hovey Williams LLP

(57) ABSTRACT

An automatic action assembly of a firearm, comprising a barrel (2) with a sliding cartridge chamber (1) arranged in a sliding way between the front and rear dead center. The movement of the sliding chamber (1) is delimited by at least one first stop (3) on the sliding chamber (1) and a corresponding at least one second stop (4) connected to the barrel (2). Between the first stop (3) and second stop (4), there is a play (A). In the rear part of the sliding chamber (1), a breech block (5) is lockably connected at the end of which a breech block (5) carrier (6) is to mounted in a sliding way. The breech block (5) carrier (6) is pushed by a return spring (7) towards the barrel (2). The breech block (5) is fitted with an unlocking mechanism for delayed disconnection of the breech block (5) from the sliding chamber (1).

7 Claims, 6 Drawing Sheets

AUTOMATIC ACTION ASSEMBLY OF A FIREARM

RELATED APPLICATION

This non-provisional patent application claims the priority benefit of Czech Patent Application Serial No. PV2019-696 entitled "Automatic Action Assembly of a Firearm," filed Nov. 12, 2019, the entire disclosure of which is incorporated herein by reference.

TECHNICAL FIELD

The invention relates to an automatic action assembly of a firearm comprising a sliding cartridge chamber arranged in a sliding way between the front and rear dead center.

BACKGROUND

Drives of the automatic function of a firearm are known that utilize the shot impulse, impulse of dust gases harvested from the barrel, drive by the pushing force of the bullet, mixed drives and drives with an external energy source. Breeches driven by harvested gases are mostly locked and are used for weapons of larger gauges. Dynamic breeches, driven by the shot force, called blowback systems, are not locked or braked in most cases and are used for lower power weapons.

With regard to high pressures of combustion gases in the barrel, a simple dynamic breech cannot be used in firearms with a powerful gauge as 5.56×45 mm or 7.62×39 mm. A breech would be able to hold combustion gases in the barrel for a sufficiently long time for the bullet to leave the barrel in case of a high weight of the breech only. Therefore, locking is used for these breeches that must be controlled by a different mechanism from mere action of the shot pressure upon the bullet bottom. Therefore, harvesting of dust gases from the barrel is extensively used in this case. Instead of combustion gas harvesting, breech braking is used, which is sensitive to production accuracy and is prone to system clogging, excessive wear and cartridge deformation.

From the document U.S. Pat. No. 4,069,607A of the applicant JUREK JULIUS V, the principle of a slidable cartridge chamber is known. However, this chamber only serves as an adapter for shooting ammunition of the .22 LR gauge, does not allow locking of the system and imparts rotation to the bullet.

The document U.S. Pat. No. 2,052,287 of the applicant SIG SCHWEIZ INDUSTRIEGES discloses a drive principle based on a short oscillation of the breech parts wherein an impulse is sent to the breech to unlock the system. However, this drive uses locking in the firearm case, is used for low power ammunition and does not have a floating chamber with locking to prevent cartridge deformation.

Therefore, it is the object of the invention to provide such an automatic action assembly of a firearm that would not feature the above-mentioned shortcomings of the prior art.

SUMMARY

The said object is achieved through an automatic action assembly of a firearm comprising a barrel with a sliding cartridge chamber, arranged in a sliding manner between the front and rear dead center, according to the invention the principle of which is that the movement of the sliding chamber is delimited by at least one first stop on the sliding chamber and a corresponding at least one second stop connected to the barrel wherein between the first stop and second stop there is a play A. In the rear part of the sliding chamber, a breech block is lockably connected at the end of which a breech block carrier is seated in a sliding way. The breech block carrier is pushed towards the barrel by a return spring. The breech block is equipped with an unlocking mechanism for delayed disconnection of the breech block from the sliding chamber.

An advantage of the assembly according to the invention is a free fit of the barrel and a consequent enhancement of shooting accuracy wherein a free fit is accompanied by minimal oscillation of the barrel. The assembly of this invention also eliminates the harvesting channel in the barrel, which is a problematic point from the service life point of view. Another benefit of the assembly according to the invention is a lower necessary installation size of the weapon thanks to the absence of a piston assembly.

Unlike known solutions using a sliding chamber, the inventive solution is to innovative in using the sliding chamber to lock the barrel and a breech with the possibility of using the conventional manner of locking consisting in a rotary breech block, a tilting bar and similar locking method.

An advantage of the assembly according to the invention as compared to other systems using "hesitation locking" is that the functional play of the drive is transferred onto the floating chamber, which makes it protected from the action of external influences as sand, dust, mud and other negative impacts.

Another clear advantage is a weight reduction of the entire system as compared to the common piston systems and braked dynamic breeches.

In a preferred embodiment, the distance between the front and rear dead center is adjustable by resetting the position of the front dead center of the sliding chamber, e.g. by turning a control collar arranged between the sliding chamber and the barrel wherein the height of the control collar is variable along its perimeter.

In a preferred embodiment, the position of the control collar is fixed with a locking lever.

Preferably, claws are arranged along the perimeter of the breech block and corresponding protrusions are arranged in the sliding chamber in such a way that the gaps between the protrusions make it possible to axially withdraw the breech block from the sliding chamber after its partial rotation.

In another preferred embodiment, multiple first stops are arranged spokewise along the perimeter of the sliding chamber, and multiple spokewise arranged second stops are connected to the barrel in such a way that the gaps between the second stops make it possible to axially withdraw the sliding chamber from the barrel after its partial rotation.

BRIEF DESCRIPTION OF DRAWINGS

The invention will be described in more detail with reference to particular embodiments shown in the accompanying drawings wherein individual figures represent.

DETAILED DESCRIPTION

An embodiment example of the automatic action assembly of a firearm according to the invention is shown schematically in FIGS. 1 to 4 in individual shooting positions.

Figure 1:
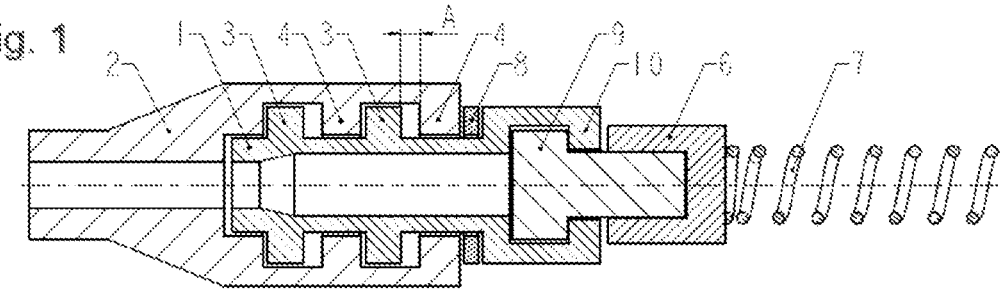
FIG. 1—a schematic illustration of the inventive assembly before a shot

FIG. 1 shows the inventive assembly before a shot. At the rear end of the barrel 2 of the firearm, in a recess, a sliding cartridge chamber 1 is arranged that is movable in a sliding way between the front and rear dead center.

In the embodiment shown, the movement of the sliding chamber 1 is delimited by two rows of the first stops 3 arranged consecutively along the outer perimeter of the sliding chamber 1, and corresponding two rows of second stops 4 connected to the barrel 2.

Figure 18:
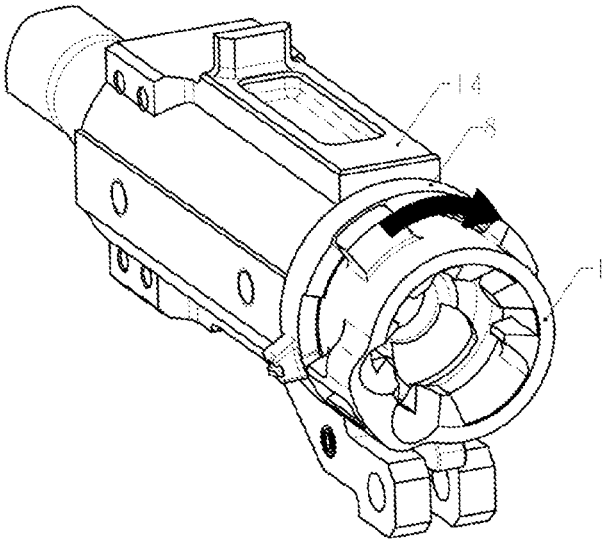
Figure 19:
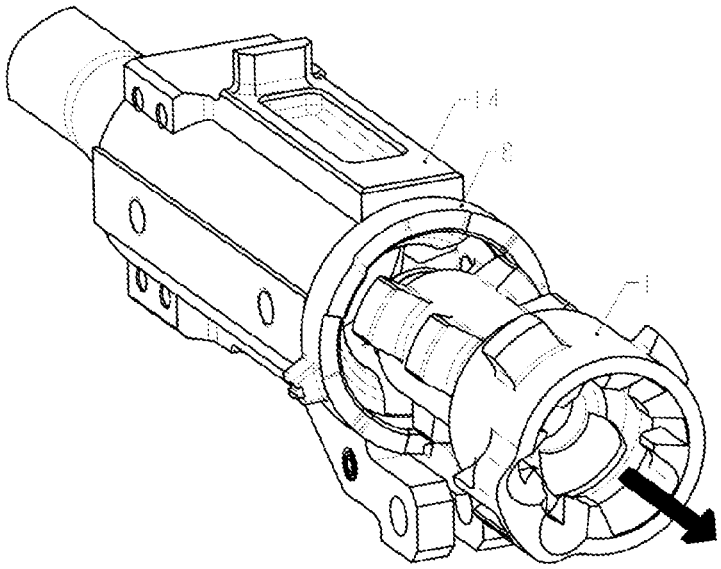

Both the rows of the first stops 3 form protrusions, spokewise projecting from the outer perimeter of the sliding chamber 1 and both the rows of the second stops 4 form corresponding protrusions, spokewise projecting from the barrel 2 wherein the gaps between the second stops 4 make it possible to axially withdraw the sliding chamber 1 from the barrel 2 after its partial rotation (see FIGS. 18 and 19). This is e.g. used for cleaning of the weapon.

Between the first stops 3 and second stops 4, there is a play A in the direction of the barrel 2 axis.

In the rear part of the sliding chamber 1, a breech block 5 is lockably connected at the end of which the breach block 5 carrier 6 is mounted in a sliding way. The breech block 5 carrier 6 is pushed towards the barrel 2 by a return spring 7. The breech block 5 is equipped with any known unlocking mechanism for delayed disconnection of the breech block 5 from the sliding chamber 1.

The distance between the front and rear dead center of the sliding chamber 1 is adjustable by resetting the position of the front dead center of the sliding chamber 1 with a rotary control collar 8 arranged on the outer perimeter of the sliding chamber 1, namely between the sliding chamber 1 and the barrel 2. In this schematic representation, the control collar 8 can be freely moved along the sliding chamber 1. The height of the front of the control collar 8 is axially graded with recesses wherein each recess step defines a minimal dead center of the sliding chamber 1 in such a way that the corresponding stops 20 arranged on the sliding chamber 1 engage the recesses. These recesses are evenly distributed along the perimeter of the control collar 8.

The position of the control collar 8 is fixed with the locking lever 11 (see FIGS. 6 to 9).

Claws 9 are arranged along the perimeter of the breech block 5 and corresponding protrusions 10 are arranged in the sliding chamber 1 in such a way that the gaps between the protrusions 10 make it possible to axially withdraw the breech block 5 from the sliding chamber 1 after its partial rotation.

Figure 2:
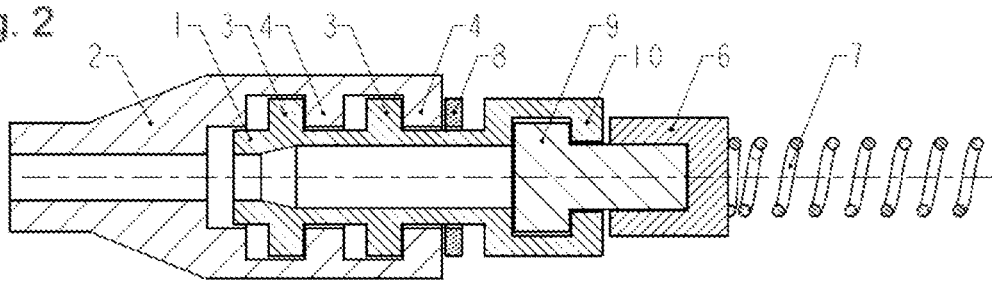
FIG. 2—the assembly of FIG. 1 at the moment of the shot

FIG. 2 shows the inventive assembly at the time of the shot, when the sliding chamber 1, breech block 5 and the breech block 5 carrier 6 have been moved by the action of the pressure of expanding gases. At this time, sufficient energy is imparted to the breech block 5 carrier 6 for inertial rearward movement.

Figure 3:
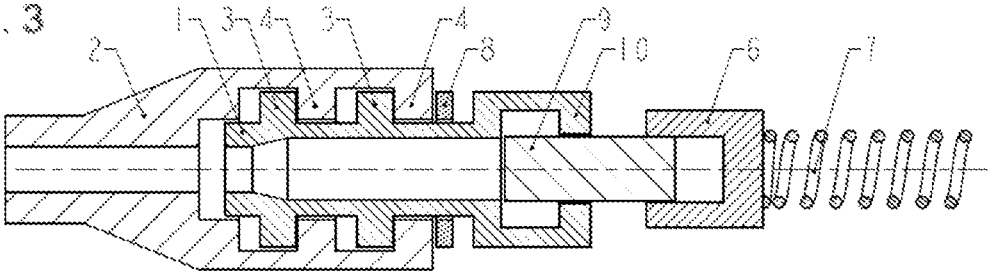
FIG. 3—the assembly of FIG. 1 in the breech block unlocking position

FIG. 3 shows the inventive assembly during unlocking of the breech block 5, when the carrier 6 of the breech block 5 keeps moving rearwards at the acquired speed, and the breech block 5 is being unlocked from the sliding chamber 1 by means of an unlocking mechanism, which is not shown here.

Figure 4:
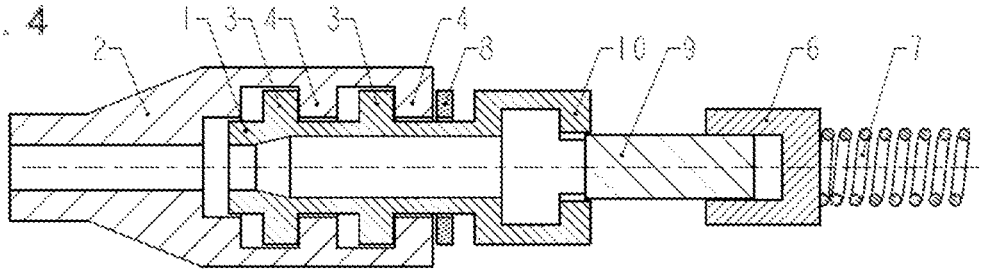
FIG. 4—the assembly of FIG. 1 in the position where the carrier is carrying the unlocked breech block with it FIG. 5—another embodiment example of the inventive assembly FIGS. 6, 7, 8 and 9—an example of a particular structural design of the assembly that is schematically shown in FIGS. 1, 2, 3 and 4

Then, FIG. 4 shows the breech block 5 carrier 6, which is carrying the unlocked breech block 5 with it.

The return spring 7 will then analogously return the entire assembly to the initial position, shown in FIG. 1.

Figure 5:
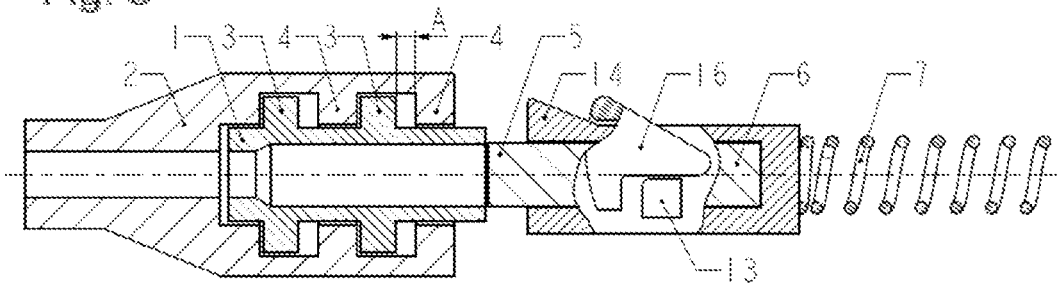

FIG. 5 shows an example of another embodiment of the inventive assembly. This assembly only differs from the embodiment of FIGS. 1 to 4 in that the breech block 5 is not locked to the sliding chamber 1, but with the use of a tilting bar 12 to the frame 13 of the firearm.

FIGS. 6, 7, 8 and 9 show an example of a particular structural design of the assembly that is schematically shown in FIGS. 1, 2, 3 and 4

Figure 6:
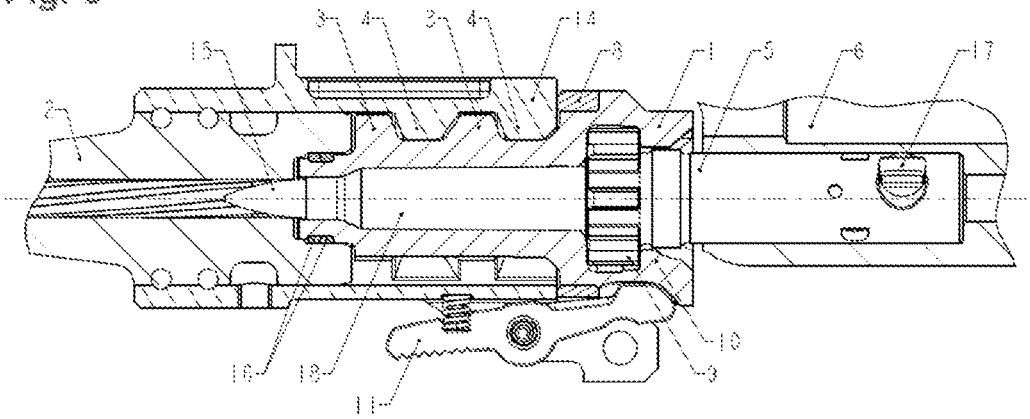

FIG. 6 shows the assembly before a shot. A rear sleeve 14 is firmly attached to the rear end of the firearm barrel 2 while in the recess of the sleeve, the sliding cartridge chamber 1 is arranged in a sliding way between the front and rear dead center.

The movement of the sliding chamber 1 is delimited by two rows of the first stops 3 arranged consecutively along the outer perimeter of the sliding chamber 1, and corresponding two rows of second stops 4, situated on the inner surface of the rear sleeve 14, which is firmly attached to the barrel 2.

Both the rows of the first stops 3 form protrusions, spokewise projecting from the outer perimeter of the sliding chamber 1 and both the rows of the second stops 4 form corresponding protrusions, spokewise projecting from the barrel 2 wherein the gaps between the second stops 4 make it possible to axially withdraw the sliding chamber 1 from the barrel 2 after its partial rotation. This is e.g. used for cleaning of the weapon.

Between the first stops 3 and second stops 4, there is a play A in the direction of the barrel 2 axis.

In the rear part of the sliding chamber 1, a breech block 5 is lockably connected at the end of which the breach block 5 carrier 6 is mounted in a sliding way. The breech block 5 carrier 6 is pushed towards the barrel 2 by a return spring 7. The breech block 5 is equipped with any known unlocking mechanism for delayed disconnection of the breech block 5 from the sliding chamber 1.

The distance between the front and rear dead center of the sliding chamber 1, i.e. the size of the play A, is adjustable by turning the rotary collar 8. Before the shot (see FIG. 6), the control collar 8 is in contact with the rear sleeve 14. This contact ensures sealing of the firearm drive against penetration of undesired solids as sand, dust, mud and other forms.

The position of the sliding chamber 1 and at the same time the control collar 8 is fixed with the locking lever 11 (see FIG. 6).

Claws 9 are arranged along the perimeter of the breech block 5 and corresponding protrusions 10 are arranged in the sliding chamber 1 in such a way that the gaps between the protrusions 10 make it possible to axially withdraw the breech block 5 from the sliding chamber 1 after its partial rotation.

You can see in the sliding chamber 1 that the bullet 15 of the cartridge is leaving the sliding chamber 1 and is in close contact with the guiding part of the barrel 2.

Figure 7:
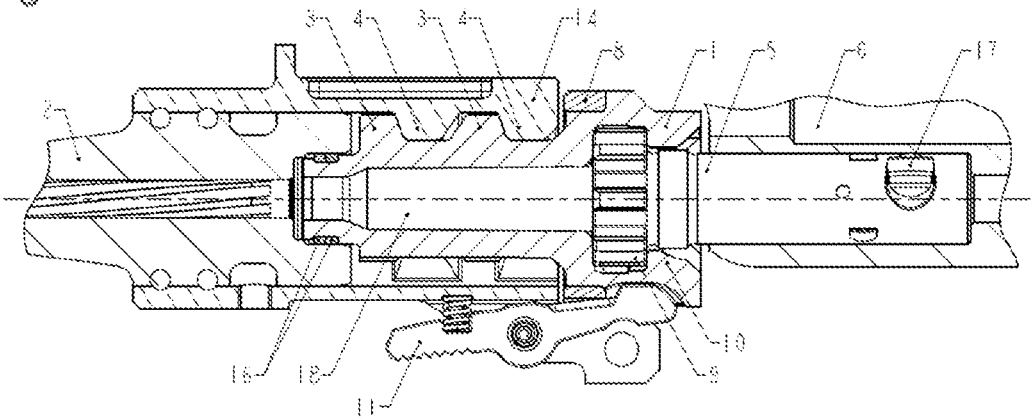

FIG. 7 shows the inventive assembly at the time of the shot, when the bullet 12 has left the barrel, 2, the sliding chamber 1 has moved back by the size of the play A and this movement has been stopped by the contact between the first stops 3 and second stops 4. Along this distance, the carrier 6 of the breech block 5 is, via the breech block 5, accelerated to the required speed for full functionality of the automatic action of the weapon. Sealing rings 16 prevent undesired blowing of gases into the space between the sliding chamber 1 and the rear sleeve 14. At this moment, the sliding chamber 1 and the breech block 5 have stopped to zero speed, but the carrier 6 of the breech block 5 continues moving inertially in the direction from the barrel 2. What is essential for the drive of the automatic action is that during the entire sliding period of the sliding chamber 1, contact between the sliding chamber 1, the breech block 5 and the carrier 6 of the breech block 5 must be ensured.

Figure 8:
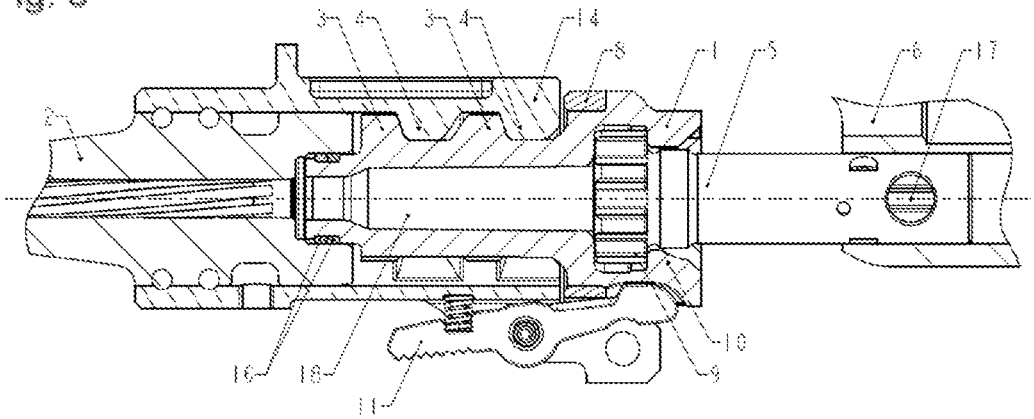

FIG. 8 shows unlocking of the breech block 5 by partial rotation around its longitudinal axis. In this particular embodiment example, the opening of the breech block 5 is governed by the control pin 17 guided by the control curve in the carrier 6 of the breech block 5. The breech block 5 is partly rotated around its longitudinal axis so that the claws 9 arranged along the perimeter of the breech block 5 can turn into the gaps between the corresponding projections 10 in the sliding chamber 1, which enables axial withdrawal of the breech block 5 from the sliding chamber 1. Unlocking is enabled by the inertial movement of the carrier 6 of the breech block 5, which acquired speed in the previous step thanks to the return movement of the sliding chamber 1 and breech block 5.

Figure 9:
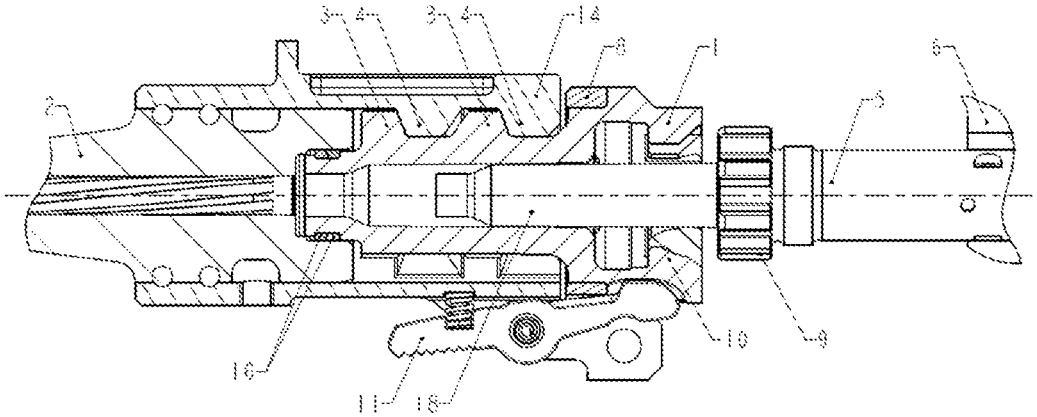

FIG. 9 shows withdrawal of a used cartridge 18. At this moment, the sliding chamber 1 is not pushed back to the front dead center, this shift is only accomplished by the return of the breech block 5 carrier 6 initiated by the return spring 7.

Figure 10:
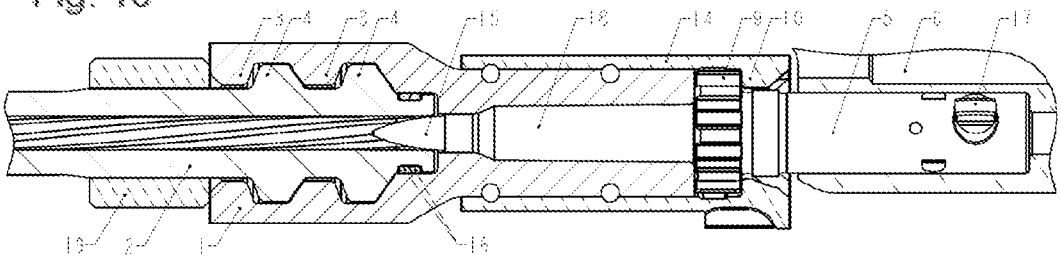
FIG. 10—another embodiment example of the inventive assembly

FIG. 10 shows a solution of the automatic action drive based on the same principle but with a different structural design from the embodiment shown in FIGS. 6, 7, 8 and 9. In this arrangement, the first stops 3 consist of protrusions that project spokewise from the inner perimeter of the sliding chamber 1 and the second stops 4 directly project from the barrel 2.

Along the perimeter of the breech block 5, claws 9 are arranged while the corresponding protrusions 10 are not arranged directly in the sliding chamber 1, but in the pressed-on rear sleeve 14. Mounting of the barrel 2 is designed via a mounting sleeve 19. An advantage of this embodiment as compared to the embodiment of FIGS. 6, 7, 8 and 9 consists in a lower and narrower structure of the weapon. Due to the weight of the sleeve 19, the center of gravity of the weapon is shifted to the front part. However, the function of this embodiment is the same as described above.

Figure 11:
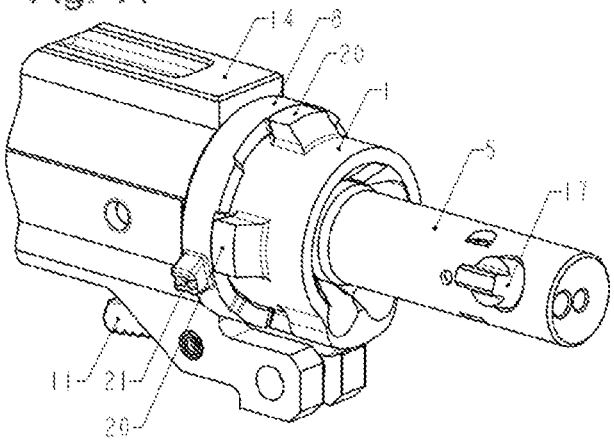
FIGS. 11, 12 and 13—setting the distance between the front and rear dead center of the sliding chamber by turning the control collar FIGS. 14, 15 and 16—different positions of the locking lever FIG. 17—a detail of the design of the joint of the locking lever and the control collar FIGS. 18, 19—a schematic illustration of disassembly of the sliding cartridge chamber
Figure 12:
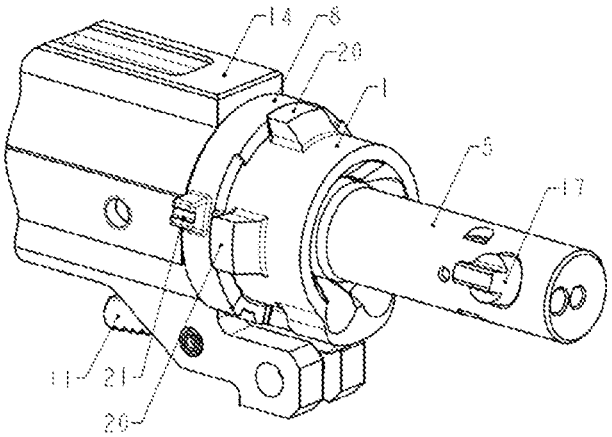
Figure 13:
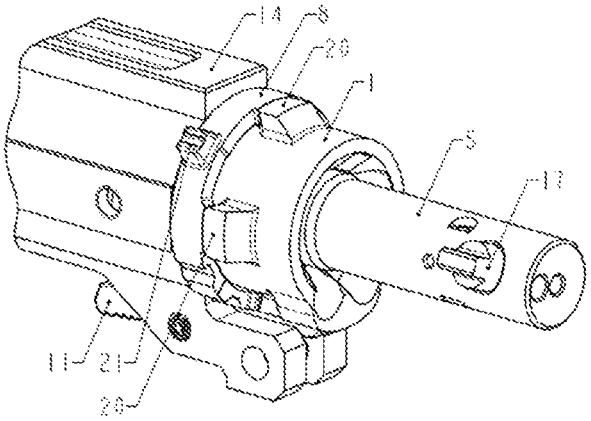
Figure 17:
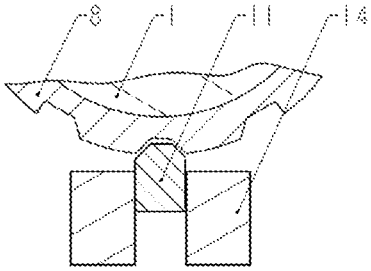

FIGS. 11, 12 and 13 show adjustment of the distance between the front and rear dead center of the sliding chamber 1, i.e. size of the play A, which is adjusted by turning of the control collar 8 by exerting pressure onto the projection 21. In the embodiment shown, the control collar 8 has three positions. In the first position (see FIG. 11), the size of the play A is adjusted for drive under common conditions. In the second position (see FIG. 12), the size of the play A is adjusted for drive under more demanding conditions when a bigger play A imparts a higher speed to the breech parts. In the third position (see FIG. 13), zero size of the play A is set for shooting with a shot noise damper when cycling of the breech parts is not desirable. The locking lever 11 is unlocked by turning of the control collar 8 by means of mutually chamfered contact surfaces (see FIG. 17). The locking lever 11 prevents spontaneous rotation of the control collar 8.

Figure 14:
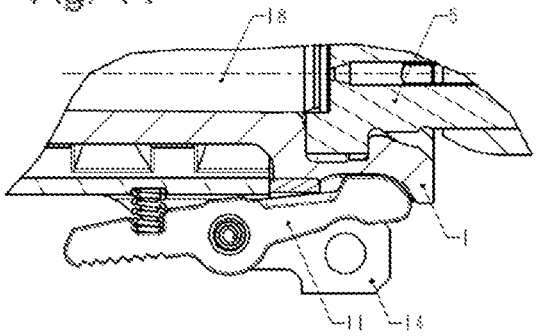
Figure 15:
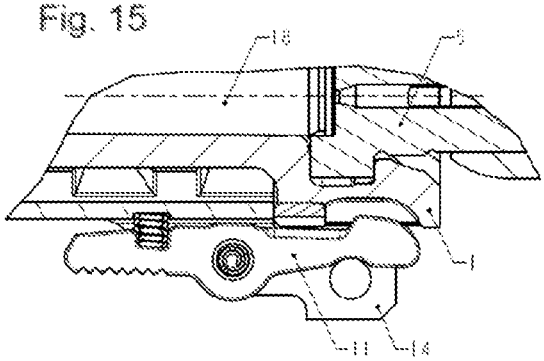
Figure 16:
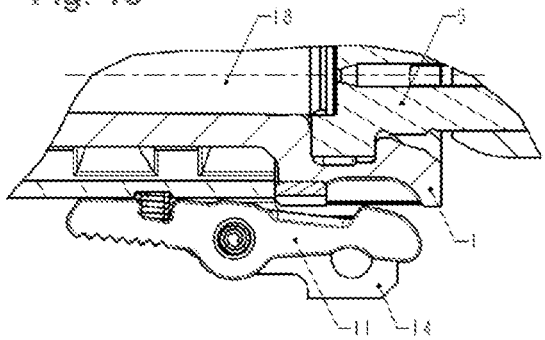

The function of the locking lever 11 is shown in FIGS. 14, 15 and 16.

In FIG. 14, the position of the control collar 8 and sliding chamber 1 is secured by the locking lever 11, which is pushed into engagement by a spring.

In FIG. 15, the locking lever 11 is released by turning of the control collar 8 by means of mutually chamfered contact surfaces. The locking lever 11 cannot be pushed further than to this position by turning of the control collar 8.

FIG. 16 shows a situation when to disassemble the weapon, the user has removed blocking of the locking lever 11, making it possible to push the locking lever 11 to the maximum position, which is not possible in normal operation. This condition enables disassembly of the sliding chamber 1 for cleaning purposes. The disassembly procedure of the sliding chamber 1 is shown in FIGS. 18 and 19.

INDUSTRIAL APPLICABILITY

The automatic action assembly of a firearm according to this invention can be used in all weapons that are driven by another type of automatic action, especially those where using powerful ammunition and achievement of a low weight and small installation dimensions are desired. The solution is not limited by the cartridge type and it is suitable for armed forces as well as civilian use.

LIST OF REFERENCE SIGNS

1 sliding chamber
2 barrel
3 first stop
4 second stop
5 breech block
6 breech block carrier
7 return spring
8 control collar
9 claw
10 protrusion
11 locking lever
12 tilting bar
13 firearm frame
14 rear sleeve
15 bullet
16 sealing ring
17 control pin
18 cartridge
19 sleeve
20 stop
21 projection

The invention claimed is:

1. An automatic action assembly of a firearm, comprising a barrel (2) with a sliding cartridge chamber (1) arranged in a sliding way between a front dead center and a rear dead center, wherein movement of the sliding chamber (1) is delimited by at least one first stop (3) on the sliding chamber (1) and a corresponding at least one second stop (4) connected to the barrel (2) wherein between the first stop (3) and second stop (4), there is a play (A), and in a rear part of the sliding chamber (1) a breech block (5) is lockably connected at an end of which a breech block (5) carrier (6) is mounted in a sliding way wherein the breech block (5) carrier (6) is pushed by a return spring (7) towards the barrel (2) wherein the breech block (5) is fitted with an unlocking mechanism for delayed disconnection of the breech block (5) from the sliding chamber (1), wherein the assembly is configured such that a distance between the front dead center and the rear dead center is adjustable by adjusting a position of the front dead center of the sliding chamber (1).

2. The assembly according to claim 1, wherein the position of the front dead center of the sliding chamber (1) is adjustable by turning of a control collar (8) arranged between the sliding chamber (1) and the barrel (2) wherein a height of the control collar (8) is variable along a perimeter of the control collar (8).

3. The assembly according to claim 2, wherein the position of the control collar (8) is fixed with a locking lever (11).

4. The assembly according to claim 1, wherein claws (9) are arranged along a perimeter of the breech block (5) and corresponding protrusions (10) are arranged in the sliding chamber (1) in such a way that gaps between the protrusions (10) make it possible to axially withdraw the breech block (5) from the sliding chamber (1) after partial rotation of the breech block (5).

5. The assembly according to claim 1, wherein multiple first stops (3) are arranged spokewise along a perimeter of the sliding chamber (1), and multiple spokewise arranged second stops (4) are connected to the barrel (2) in such a way that gaps between the second stops (4) make it possible to axially withdraw the sliding chamber (1) from the barrel (2) after partial rotation of the sliding chamber (1).

6. An automatic action assembly of a firearm, comprising a barrel (2) with a sliding cartridge chamber (1) arranged in a sliding way between a front dead center and a rear dead center, wherein movement of the sliding chamber (1) is delimited by at least one first stop (3) on the sliding chamber (1) and a corresponding at least one second stop (4) connected to the barrel (2) wherein between the first stop (3) and second stop (4), there is a play (A), and in a rear part of the sliding chamber (1) a breech block (5) is lockably connected at an end of which a breech block (5) carrier (6) is mounted in a sliding way wherein the breech block (5) carrier (6) is pushed by a return spring (7) towards the barrel (2) wherein the breech block (5) is fitted with an unlocking mechanism for delayed disconnection of the breech block (5) from the sliding chamber (1), wherein claws (9) are arranged along a perimeter of the breech block (5) and corresponding protrusions (10) are arranged in the sliding chamber (1) in such a way that gaps between the protrusions (10) make it possible to axially withdraw the breech block (5) from the sliding chamber (1) after partial rotation of the breech block (5).

7. An automatic action assembly of a firearm, comprising a barrel (2) with a sliding cartridge chamber (1) arranged in a sliding way between a front dead center and a rear dead center, wherein movement of the sliding chamber (1) is delimited by at least one first stop (3) on the sliding chamber (1) and a corresponding at least one second stop (4) connected to the barrel (2) wherein between the first stop (3) and second stop (4), there is a play (A), and in a rear part of the sliding chamber (1) a breech block (5) is lockably connected at an end of which a breech block (5) carrier (6) is mounted in a sliding way wherein the breech block (5) carrier (6) is pushed by a return spring (7) towards the barrel (2) wherein the breech block (5) is fitted with an unlocking mechanism for delayed disconnection of the breech block (5) from the sliding chamber (1), wherein multiple first stops (3) are arranged spokewise along a perimeter of the sliding chamber (1), and multiple spokewise arranged second stops (4) are connected to the barrel (2) in such a way that gaps between the second stops (4) make it possible to axially withdraw the sliding chamber (1) from the barrel (2) after partial rotation of the sliding chamber (1).

* * * * *